US010123599B2

(12) United States Patent
Kao et al.

(10) Patent No.: US 10,123,599 B2
(45) Date of Patent: Nov. 13, 2018

(54) LUGGAGE BAG WITH ORGANIZER

(71) Applicant: OREGAMI, LLC, Fairview, OR (US)

(72) Inventors: David Kao, Portland, OR (US); Richard P. Christen, Bend, OR (US)

(73) Assignee: OREGAMI, LLC, Fairview, OR (US)

( * ) Notice: Subject to any disclaimer, the term of this patent is extended or adjusted under 35 U.S.C. 154(b) by 149 days.

(21) Appl. No.: 14/941,950

(22) Filed: Nov. 16, 2015

(65) Prior Publication Data

US 2016/0066666 A1 Mar. 10, 2016

Related U.S. Application Data

(63) Continuation-in-part of application No. 14/293,588, filed on Jun. 2, 2014, now Pat. No. 9,215,918.

(60) Provisional application No. 61/833,270, filed on Jun. 10, 2013.

(51) Int. Cl.

| | |
|---|---|
| ***A45C 5/06*** | (2006.01) |
| ***A45C 7/00*** | (2006.01) |
| ***A45C 5/14*** | (2006.01) |
| ***A45C 3/00*** | (2006.01) |
| ***A45C 13/03*** | (2006.01) |

(52) U.S. Cl.

CPC ..... *A45C 7/0045* (2013.01); *A45C 3/004* (2013.01); *A45C 5/06* (2013.01); *A45C 5/14* (2013.01); *A45C 13/03* (2013.01); *A45C 2003/002* (2013.01)

(58) Field of Classification Search

CPC ..... A45C 7/0045; A45C 5/14; A45C 7/0086; A45C 5/00; A45C 3/00

USPC ..... 190/108, 100, 110, 18 A; 206/289, 292, 206/293, 298, 316.2, 579, 315.1

See application file for complete search history.

(56) References Cited

U.S. PATENT DOCUMENTS

| | | | | |
|---|---|---|---|---|
| 2,082,011 | A * | 6/1937 | Lee | A45C 13/02 206/293 |
| 3,530,961 | A | 9/1970 | Weissenbach | |
| 4,718,524 | A | 1/1988 | Crumley | |
| 4,887,751 | A | 12/1989 | Lehman | |
| 5,096,030 | A | 3/1992 | Espinosa et al. | |
| 5,240,106 | A * | 8/1993 | Plath | A45C 5/14 190/102 |
| 5,624,026 | A | 4/1997 | Chernoff | |

(Continued)

*Primary Examiner* — Fenn C Mathew
*Assistant Examiner* — Cynthia Collado
(74) *Attorney, Agent, or Firm* — Renaissance IP Law Group, LLP; David A. Crowther

(57) ABSTRACT

Embodiments of the invention provide a luggage bag and an overhead luggage bag, which include an outer container and an organizer that is contained therein. The organizer includes a built-in compartment and a plurality of removable foldable compartments. The organizer can be stored within the outer container and covered by an outer flap. The compartments can stack and fold onto each other and can fold into and out of the outer container. The compartments can be removably attached to each other. The compartments can be modular such that the organizer can be configured to include any desired number of compartments. The compartments of the organizer can unfold, deploy, and extend from the outer container. The overhead luggage bag can include one or more easy-access portals through which contents of the luggage bag can be conveniently accessed without fully opening the luggage bag.

16 Claims, 14 Drawing Sheets

(56) References Cited

U.S. PATENT DOCUMENTS

| | | | | |
|---|---|---|---|---|
| 6,098,769 | A * | 8/2000 | Yen | A45C 5/14 190/102 |
| 6,168,022 | B1 | 1/2001 | Ward et al. | |
| 6,213,267 | B1 * | 4/2001 | Miller | A45C 7/0086 190/102 |
| 6,435,324 | B1 * | 8/2002 | Hoberman | A45C 13/02 190/110 |
| 6,523,653 | B2 | 2/2003 | Roegner | |
| 6,715,594 | B2 * | 4/2004 | Milionta | A01K 97/06 150/111 |
| 2004/0173427 | A1 | 9/2004 | Chernoff | |
| 2007/0044877 | A1 | 3/2007 | Davidoff et al. | |

* cited by examiner

LUGGAGE BAG WITH ORGANIZER

RELATED APPLICATION DATA

This application is a continuation in part of commonly assigned U.S. patent application Ser. No. 14/293,588, filed Jun. 2, 2014, which claims the benefit of commonly assigned U.S. Provisional Pat. Application Ser. No. 61/833,270, filed Jun. 10, 2013, which are hereby incorporated by reference in their entirety.

FIELD OF THE INVENTION

This application pertains to luggage, and more particularly, to a luggage bag having an organizer containable therein.

BACKGROUND

Millions of travelers go from one place to another every day around the world. The travelers usually must carry their personal belongings in some kind of bag or container, especially if the trip lasts for more than one day. Various types of luggage, baggage, and related containers have been proposed for transporting items safely and securely from one destination to another. However, conventional luggage and bags are often bulky and awkward, and fail to provide the ability to efficiently fit, organize, and access a person's belongings. For larger luggage bags that are typically "checked" when boarding a plane or ship, the contents can get jumbled and disorganized over the course of the trip. For smaller carry-on type luggage, it is difficult or impossible to gain access to the contents without fully opening the luggage bag. This can be problematic because of the tight travel quarters that are common among airplanes, ships, trains, or the like.

Another downside of conventional luggage is the failure to accommodate various types of belongings in a single container. For example, if a person wishes to travel with garments such as suits and dress shirts without ruining or wrinkling the garments, they must carry two separate bags—one to accommodate the suits and dress shirts, and another to accommodate their remaining belongings. As travel companies such as airlines continue to increase fees on baggage and limit options on what can be carried on to a plane, for example, significant frustration for travelers can mount. Moreover, if one is forced to use multiple separate bags, there is a greater likelihood of losing a traveler's personal items to carelessness or theft.

Accordingly, a need remains for an improved luggage bag having an internal organizer, with easy access to internal contents, and which also accommodates multiple types of personal belongings including garments and other belongings. Embodiments of the invention address these and other limitations in the prior art.

The foregoing and other features of the invention will become more readily apparent from the following detailed description, which proceeds with reference to the accompanying drawings.

DETAILED DESCRIPTION OF THE EMBODIMENTS

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, and components, have not been described in detail so as not to unnecessarily obscure aspects of the embodiments.

It will be understood that, although the terms first, second, etc. may be used herein to describe various elements, these elements should not be limited by these terms. These terms are only used to distinguish one element from another. For example, a first handle could be termed a second handle, and, similarly, a second handle could be termed a first handle, without departing from the scope of the inventive concept.

It will be understood that when an element or layer is referred to as being "on," "coupled to" or "connected to" another element or layer, it can be directly on, directly coupled to or directly connected to the other element or layer, or intervening elements or layers may be present. In contrast, when an element is referred to as being "directly on," "directly coupled to" or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
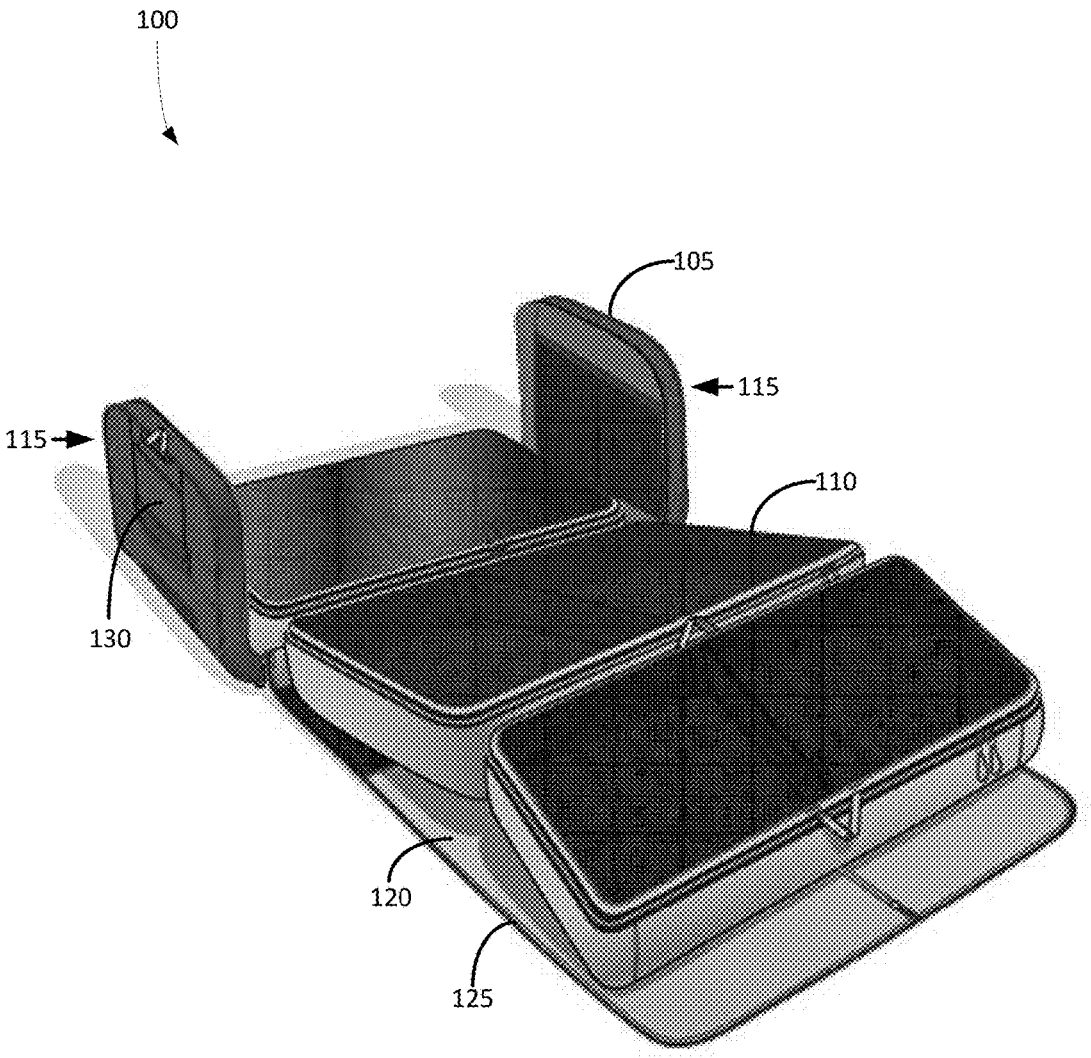
FIG. 1 illustrates a luggage bag including an outer container in an opened configuration and a removable organizer in accordance with various inventive concepts of the present invention.
Figure 2:
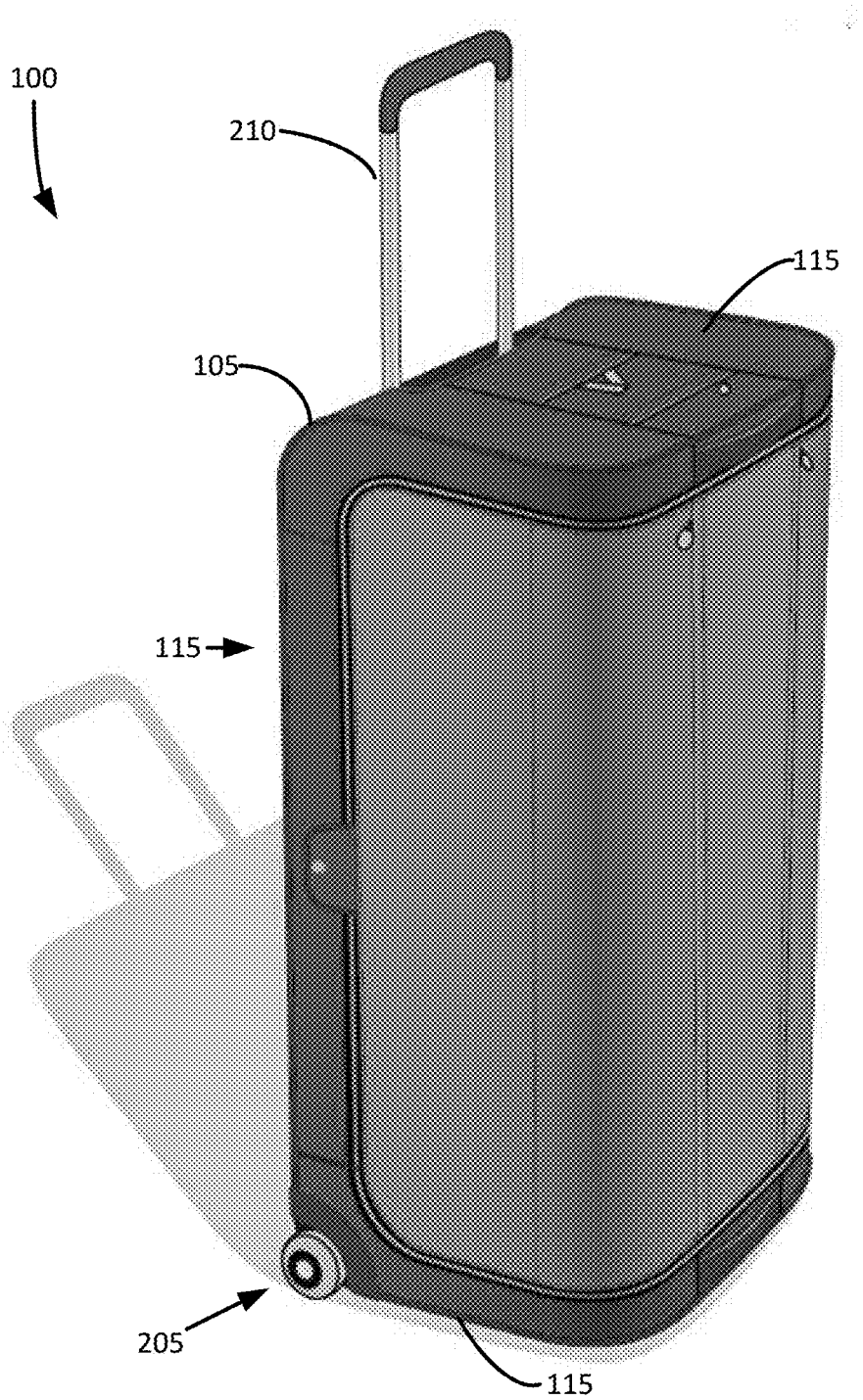
FIG. 2 illustrates the luggage bag of FIG. 1 in a closed configuration.

FIG. 1 illustrates a luggage bag 100 including an outer container 105 in an opened configuration and a removable organizer 110 in accordance with various inventive concepts of the present invention. FIG. 2 illustrates the luggage bag 100 of FIG. 1 in a closed configuration. Reference is now made to FIGS. 1 and 2.

The luggage bag 100 generally includes an outer container 105 and a removable organizer 110, which can be contained within the outer container 105. As will be discussed, the organizer 110 allows items to be stored securely and conveniently within the container 105. Also, the organizer 110 fits neatly into the container 105. Moreover, the organizer 110 can be modular and configurable for additional benefits, which are discussed in detail below.

The outer container 105 can be of any suitable type. For example, the container 105 can have rigid walls (e.g., 115) so that it essentially maintains its shape whether in the opened configuration as shown in FIG. 1 or the closed configuration as shown in FIG. 2. Alternatively, the container 105 can have flexible or collapsible walls (e.g., 115). The container 105 can also include a closure flap 120, which can include connective means such as a zipper 125 that allows the closure flap 120 to be selectively connected or disconnected from the walls 115, thereby placing the luggage bag 100 into either the closed configuration or the open configuration, respectively. The luggage bag 100 can include an external-access storage area 130, which can store a smart phone, airline ticket information, and the like.

The outer container 105 can also include other features that enhance portability. For example, the container 105 can include one or more wheels 205, which can be attached at the joining region of two or more walls 115, as shown in FIG. 2. The container 105 can also include a telescoping handle 210 (FIG. 2). It will be appreciated, that the container 105 can vary in many ways from the container 105 shown in the Figures. Indeed, the container 105 can be of any suitable type, can have any suitable shape, and can incorporate one or more additional features typically found on other bags, luggage, briefcases, handbags, purses, and the like.

Figure 3:
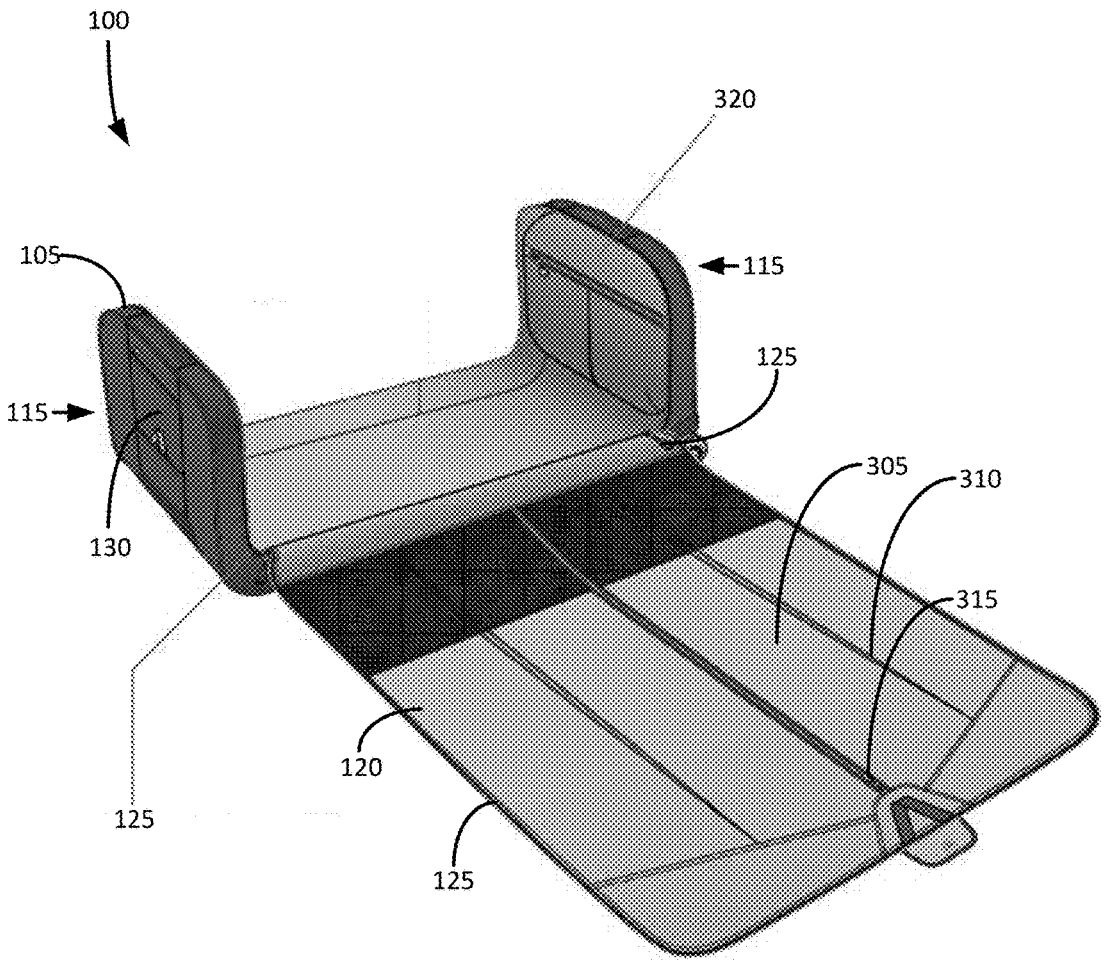
FIG. 3 illustrates the luggage bag of FIG. 1 in the opened configuration without the removable organizer, thereby revealing a detachable garment flap in accordance with various inventive concepts of the present invention.
Figure 4:
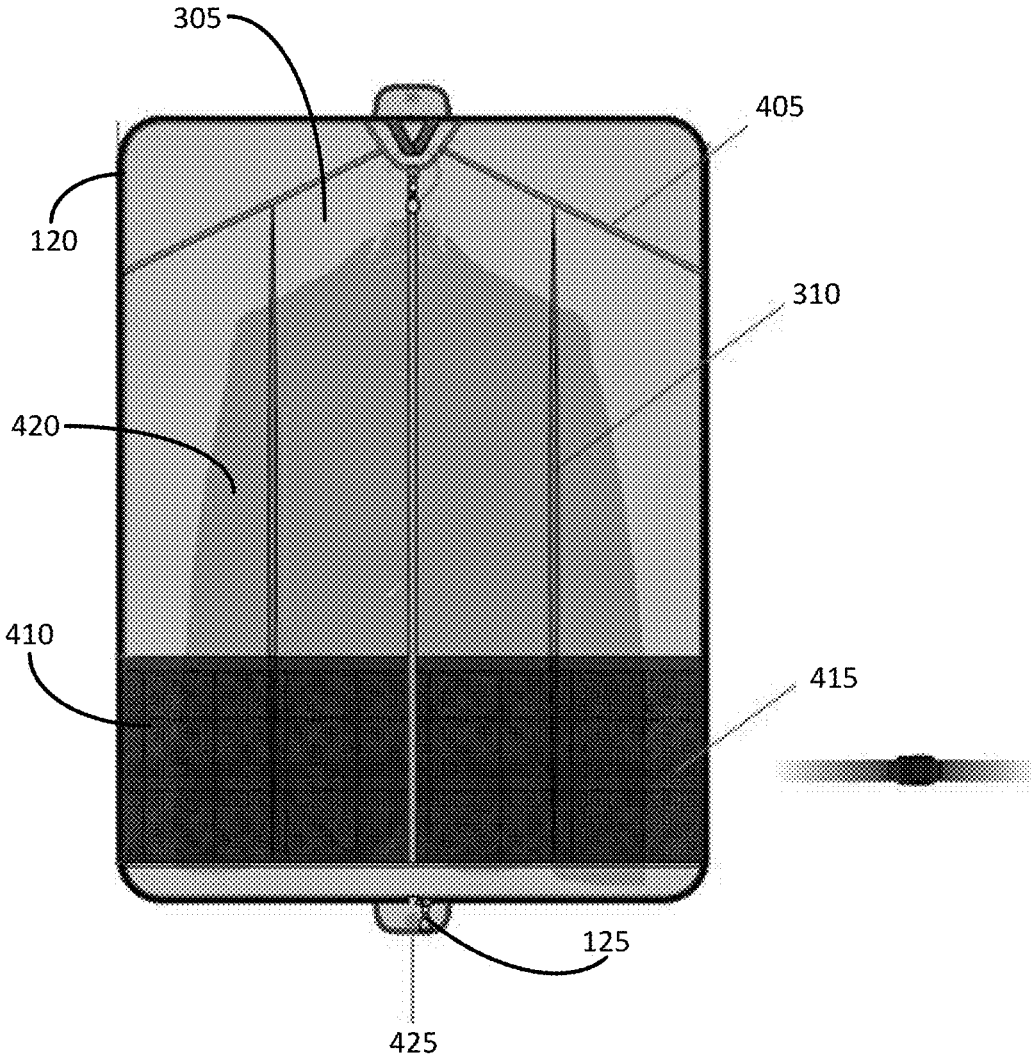
FIG. 4 illustrates the detachable garment flap of FIG. 3.

FIG. 3 illustrates the luggage bag 100 of FIG. 1 in the opened configuration without the removable organizer, thereby revealing a detachable garment flap 120 in accordance with various inventive concepts of the present invention. FIG. 4 illustrates the detachable garment flap 120 of FIG. 3. Reference is now made to FIGS. 1-4.

The closure flap 120 can be a detachable garment flap 120. The detachable garment flap 120 can include an envelope 305 in which garments such as suits, pants, shirts and the like can be neatly stored and transported. The detachable garment flap 120 is interchangeable with one or more different garment flaps to accommodate style preference, color, size, or the like. The envelope 305 can include one more pleated gussets 310 so that the volume of the envelope can automatically expand to accommodate multiple garments. The detachable garment flap 120 can be attached or detached to and from the luggage bag 100 using connection means such as the zipper 125. Other suitable connection means can include Velcro®, buttons, snaps, or the like. The garment flap 120 can also include its own zipper 315 or other suitable opening and closing means such as Velcro®, buttons, snaps, or the like, to enable efficient and convenient access to the envelope 305.

Referring to FIG. 4, the detachable garment flap 120 can include one or more shoulder seams 405. The volume of the envelope 305 can stop or otherwise be defined at least in part by the one or more shoulder seams 405. The garment flap 120 can also include webbing 410 for added ventilation. In addition, the garment flap 120 can include a strap and buckle mechanism 415 or other similar means for gathering and/or securing a lower portion of the various garments 420 stored within the envelope 305. The detachable garment flap 120 can include one or more sub-flaps 425 for covering and/or securing the zipper 125, as further described below.

One or more cargo pockets 320 may be disposed within the container 105, for example, on inside regions of the walls 115. The one or more cargo pockets 320 can each include its own zipper 315 or other suitable opening and closing means such as Velcro®, buttons, snaps, or the like.

Figure 5A:
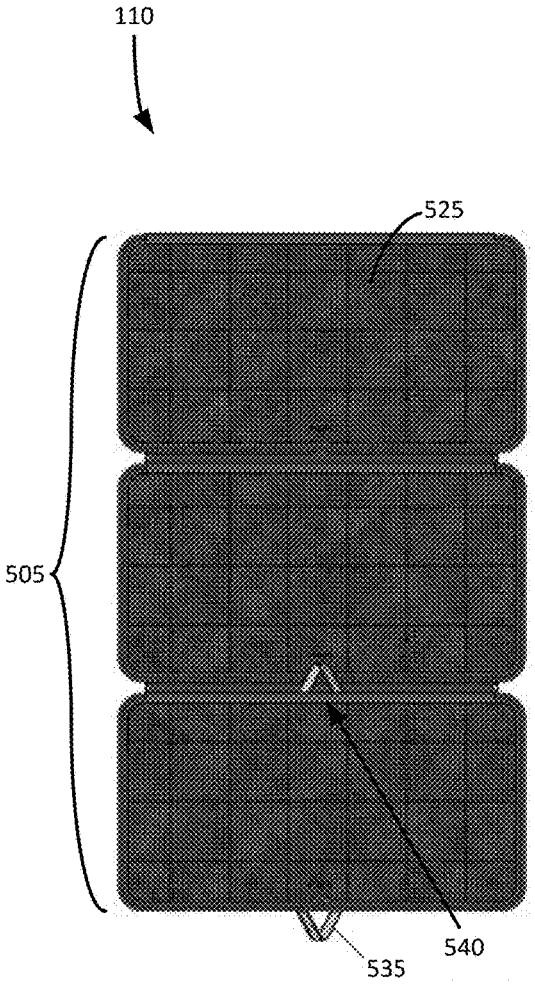
FIGS. 5A and 5B illustrate different views of the organizer of FIG. 1 including various compartments removed from the container of FIG. 1.
Figure 5B:
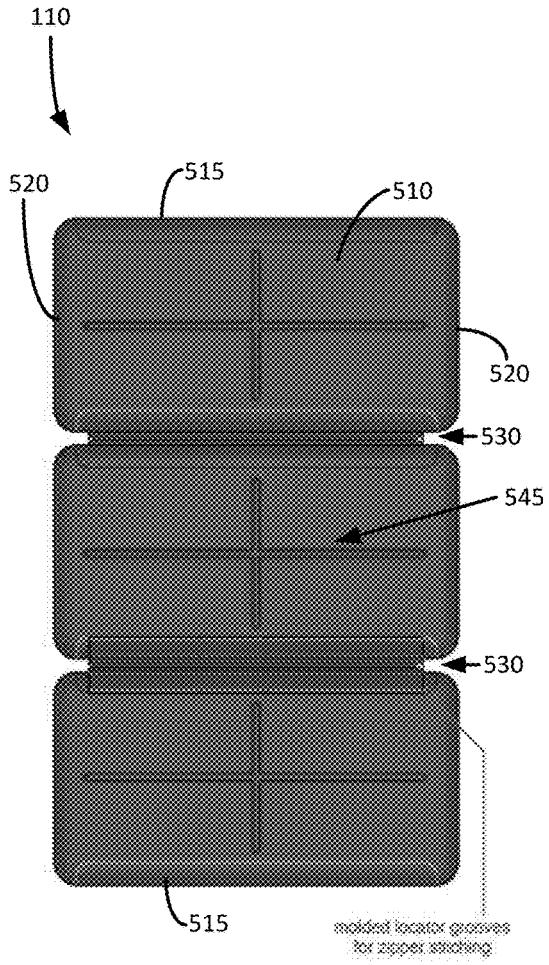
Figure 6:
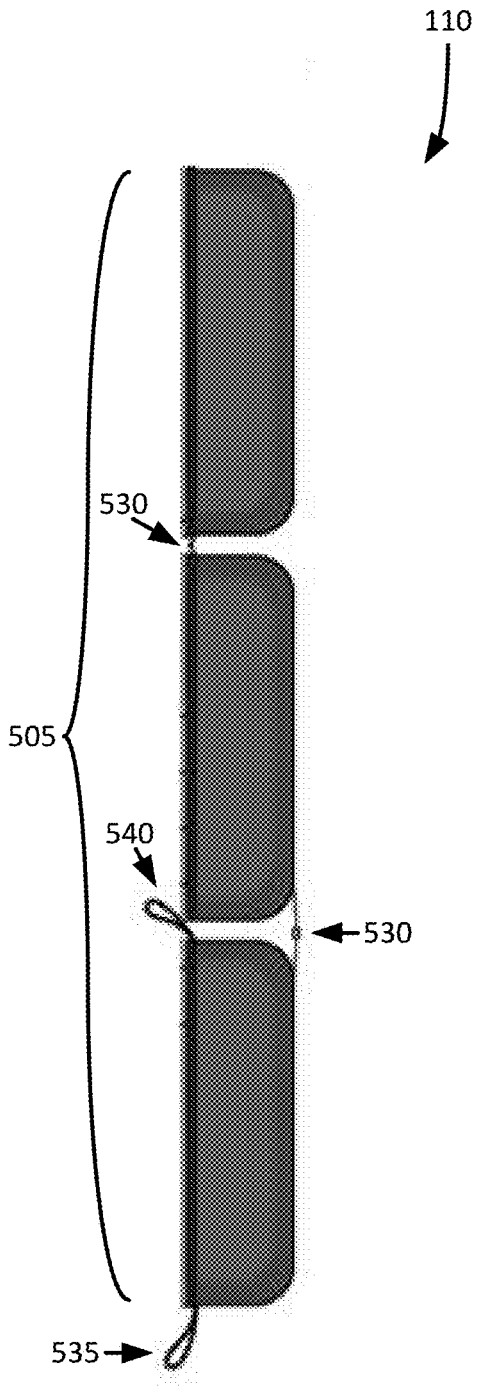
FIG. 6 illustrates another view of the organizer of FIG. 1.
Figure 7A:
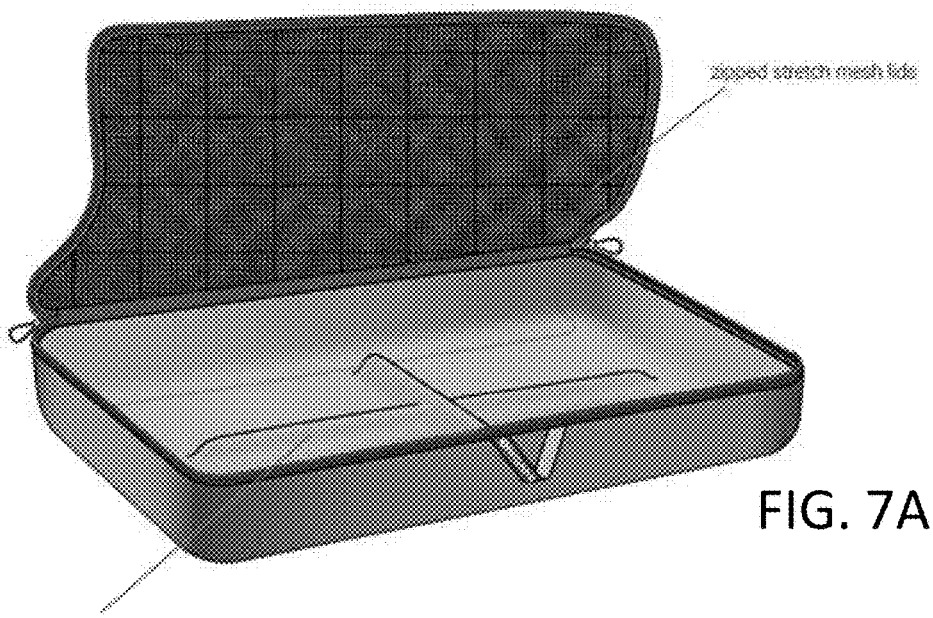
FIGS. 7A, 7B, and 7C illustrate various perspective views of a single compartment of the organizer of FIG. 1.
Figure 7B:
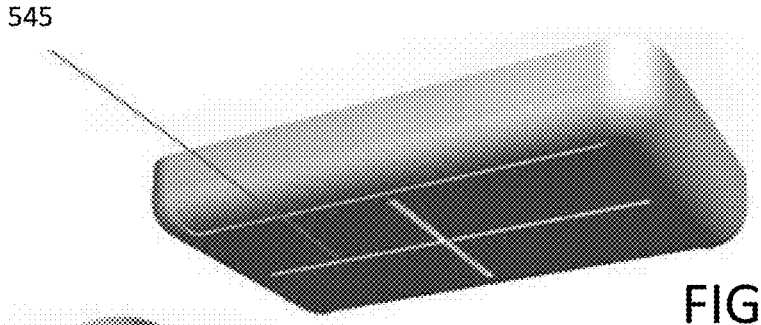
Figure 7C:
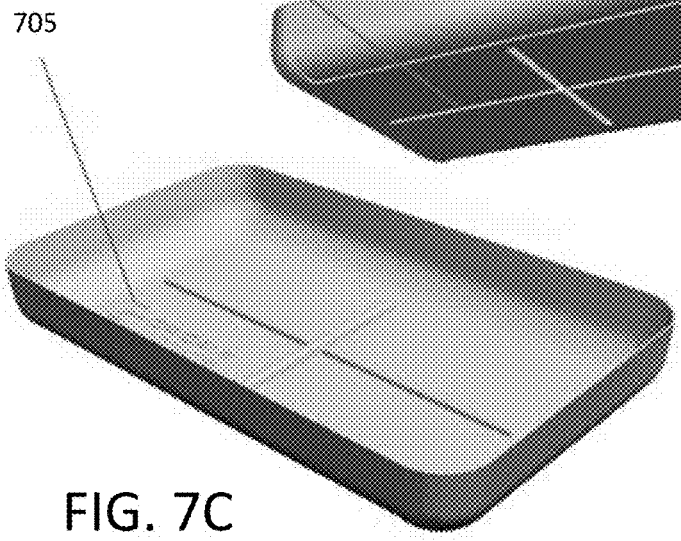
Figure 8:
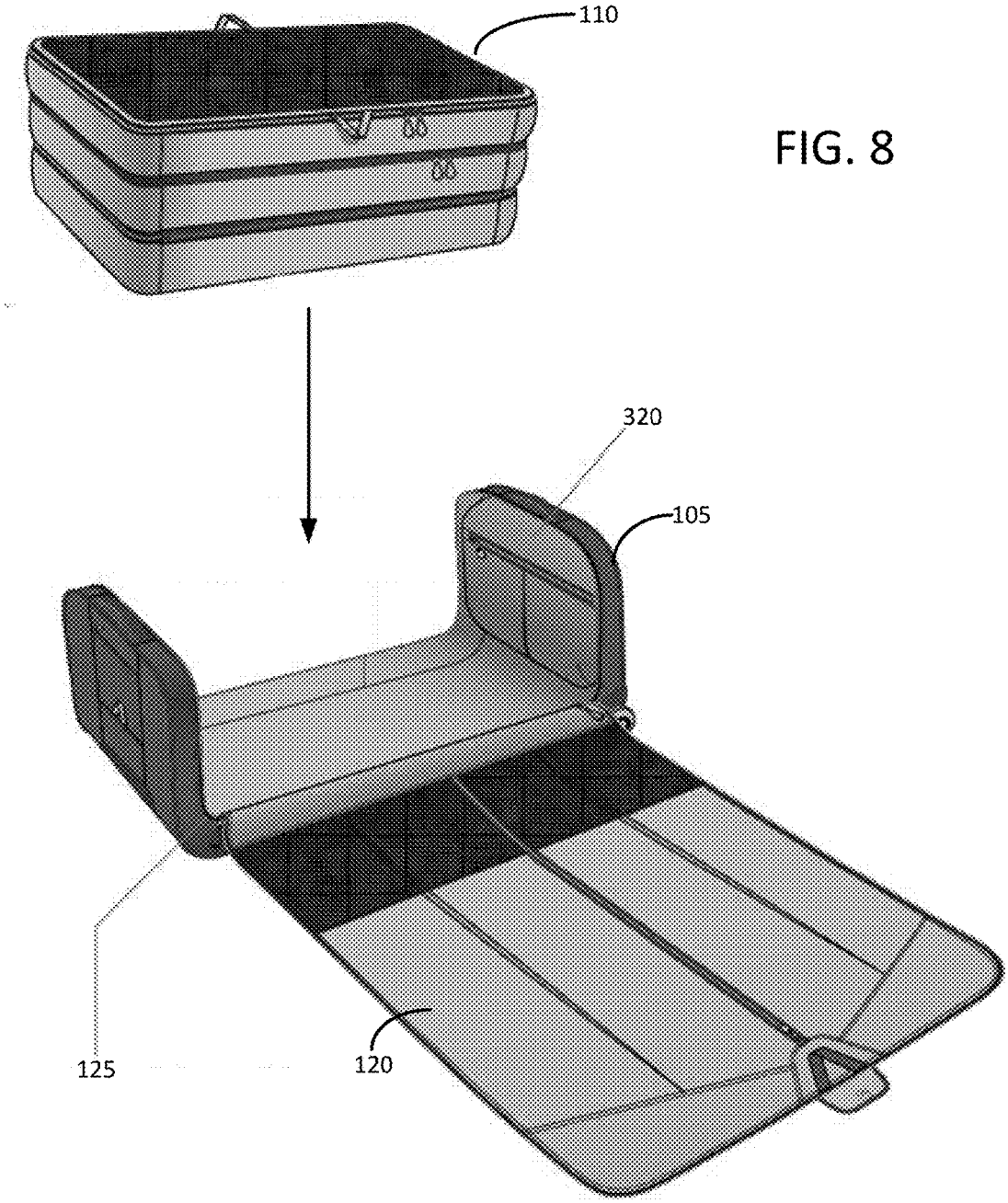
FIG. 8 illustrates the luggage bag of FIG. 1 including an outer container in an opened configuration and a removable organizer in a folded configuration in accordance with various inventive concepts of the present invention.

FIGS. 5A and 5B illustrate different views of the organizer 110 of FIG. 1 including various compartments 505 removed from the container of FIG. 1. FIG. 6 illustrates another view of the organizer 110 of FIG. 1. FIGS. 7A, 7B, and 7C illustrate various perspective views of a single compartment 505 of the organizer 110 of FIG. 1. FIG. 8 illustrates the luggage bag 100 of FIG. 1 including an outer container 105 in an opened configuration and a removable organizer 110 in a folded configuration in accordance with various inventive concepts of the present invention. Reference is now made to FIGS. 5A, 5B, 6, 7A, 7B, 7C, and 8.

The organizer 110 can include a plurality of hollow compartments 505. Each compartment 505 can include a plurality of walls 510, 515, 520, and 525 made out of compression molded material, which can include plastic, metal, rubber, composite material, or the like. Alternatively, the walls of each of the compartments 505 can be made of fabric or other suitable material. Each compartment 505 can be generally cuboid shaped. As such, each compartment 505 can include a bottom wall 510. Each compartment 505 can also include two long sidewalls 515 and two short sidewalls 520. The sidewalls 515 and 520 can trace the periphery of the bottom wall 510 and can extend substantially perpendicularly therefrom. The long sidewalls 515 can be opposite each other, and the short sidewalls 520 can be opposite each other.

Each compartment 505 can further include a top wall 525, which can be connected to the sidewalls 515 and 525, and that is opposite the bottom wall 510. The bottom wall 510 and sidewalls 515 and 520 can be substantially opaque while the top wall 525 can be at least partially light-transmissive. For instance, the top wall 525 can be made of a see-through mesh material and/or stretch-mesh material. The top wall 525 can also be at least partially removably attached to one or more of the sidewalls 515 and 520, for instance, via a zipper, snaps, or other closure. Accordingly, the top wall 525 can be detached (e.g., unzipped) from one or more of the sidewalls 515 and 520 to provide access into the compartment 505, and items can be placed within the compartment 505. Then, the top wall 525 can be selectively attached (e.g., zipped) to the sidewalls 515 and 520 to secure the items within the compartment 505.

The organizer 110 can include any suitable number of individual compartments 505. In the embodiments shown, there are three compartments 505, and the compartments fold and stack on each other. Thus, as shown in FIG. 8, the organizer 110 can be folded and stacked to be stored within the outer container 105, and the garment flap 120 can be closed over and can encapsulate the organizer 110. Then, when desired, the compartments 505 can be entirely removed from the container 105 and unfolded to deploy and extend from the container 105 as shown in FIG. 1. Moreover, the organizer 110 can be completely removed from the container 105 as shown in FIG. 8.

As shown in FIGS. 5A, 5B, and 6, the compartments 505 can be connected to each other via a connector 530. The connector 530 can be stitching or other type that permanently fixes the compartments 505 together. In other embodiments, the connector 530 can be a zipper, pile tape (e.g., VELCRO™), snaps, buttons, or other suitable connector for removably connecting the compartments 505. The compartments 505 can be aligned (when unfolded) such that adjacent long sidewalls 515 are connected together. Also, the connector 530 can be located along one edge or region of the bottom wall 510 or along one edge or region of the top wall 525. For instance, a bottom connector 530 can connect adjacent bottom walls 510, and a top connector 530 can connect adjacent top walls 525.

The middle compartment 505 of the organizer 110 includes the bottom connector 530 on one side and the top connector 530 on the opposite side. The top and bottom connectors 530 can, thus, alternate along the entire length of the organizer 110 such that the compartments 505 can stack up in sequence in a compact manner. The organizer 110 can be modular such that the compartments 505 can be configured in any desirable manner. For example, one or more compartments 505 can be attached and added to the organizer 110, or one or more compartments 505 can be detached and removed from the organizer 110.

Also, in some embodiments, the compartments 505 can include available connectors 530 extending along the short sidewalls 520 as well as along the long sidewalls 515 such that the compartments 505 can unfold to be aligned or transverse to each other. This modularity allows the organizer 110 to be configured as desired. The various compartments are foldable one atop the other. The organizer 110 can, thus, take up substantially the entire interior volume of the outer container 105 or less than the entire interior volume.

The organizer 110 can also include a first pull handle 535 or strap and a second pull handle 540 or strap. The pull handles can be, for example, a molded rubber pull or handle. Alternatively, the pull handles can be made of material, metal, plastic, or the like. The pull handles 535 and 540 can be located on the organizer 110 to facilitate moving the organizer 110 into and out of the outer container 505. For instance, the first pull handle 535 can be fixed to the outermost compartment 505, located at the end of the organizer 110, and the first pull handle 535 can be pulled to unfold, and deploy the organizer 110 from the container 105. Also, the compartment 505 at the end of the organizer 110 opposite the first pull handle 535 can be removably coupled to the container 105 (e.g., by pile tape, snaps, etc.) to facilitate deployment of the organizer 110 from the container 105.

Furthermore, as shown in FIGS. 5A, 5B, and 6, the second pull handle 540 can be included between the middle compartment 505 and the outermost compartment 505, and the second pull handle 540 can be lifted such that gravity causes folding of the compartments 505 on each other. The second pull handle 540 can then be used to further fold the compartments 505 on each other and move the organizer 110 into the container 105.

Also, when the organizer 110 is deployed from the container 105, the compartments 505 can face the same direction such that the top walls 525 are each aligned in a substantially continuous row. As such, the contents of each of the compartments 505 can be visible, and the compartments 505 can be highly accessible when deployed from the container 105.

It will be appreciated that the organizer 110 can be used within any suitable container and/or can be used and sold independently from the outer container 105. Also, individual compartments 505 can be sold separately and added to the organizer 110 as needed. Moreover, the compartments 505 within the organizer 510 can include interior dividing walls 545 for further separating or securing items within the respective compartment 505. The dividing walls 545 can be molded into the individual compartments 505 and/or have a height that is less than the height of the walls of each compartment 505. A debossed logo 705 can be imprinted directly into one or more of the walls 510.

Figure 9A:
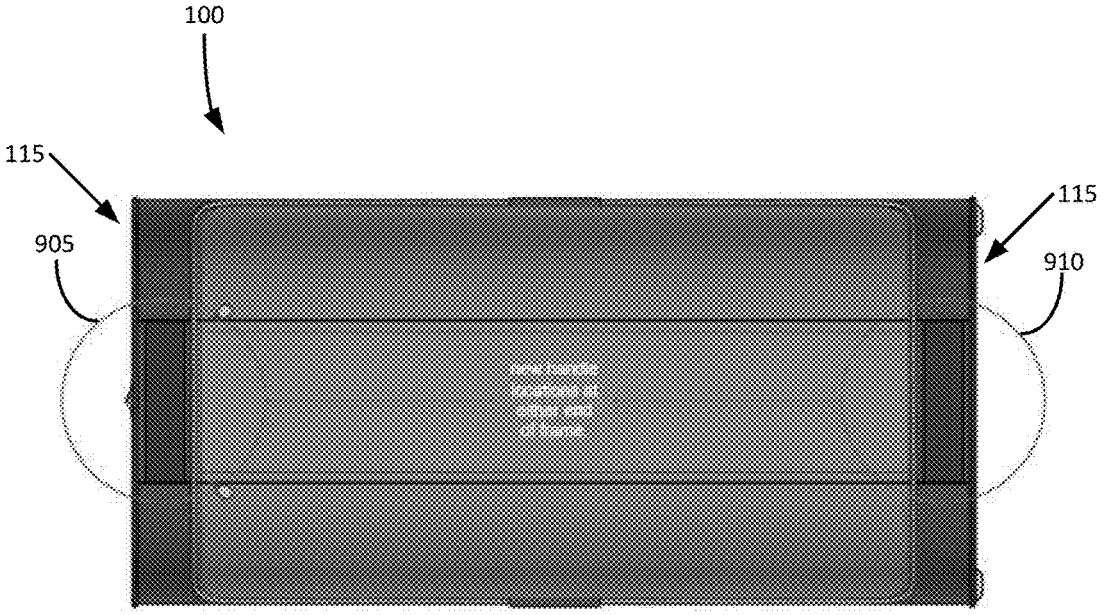
FIGS. 9A and 9B illustrate the luggage bag of FIG. 1 in the closed configuration, including multiple grab handles disposed thereon.
Figure 9B:
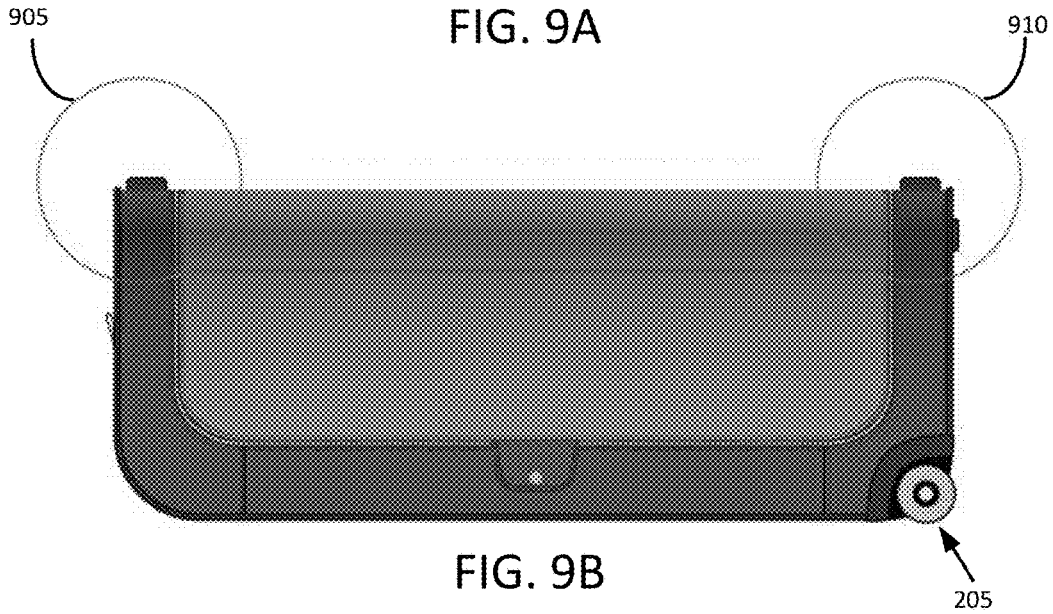

FIGS. 9A and 9B illustrate the luggage bag 100 of FIG. 1 in the closed configuration, including multiple grab handles 905 and 910 disposed thereon. As shown in FIGS. 9A and 9B, the luggage bag 100 can include a first grab handle 905 disposed atop one of the walls 115 opposite the telescoping handle 210 (FIG. 2). In addition, the luggage bag 100 can include a second grab handle 910 disposed atop another of the walls 115 opposite the one or more wheels 205. In this manner, the first and second grab handles 905 and 910 provide two-handed horizontal lifting from a trunk or baggage carousel, for example.

Figure 10:
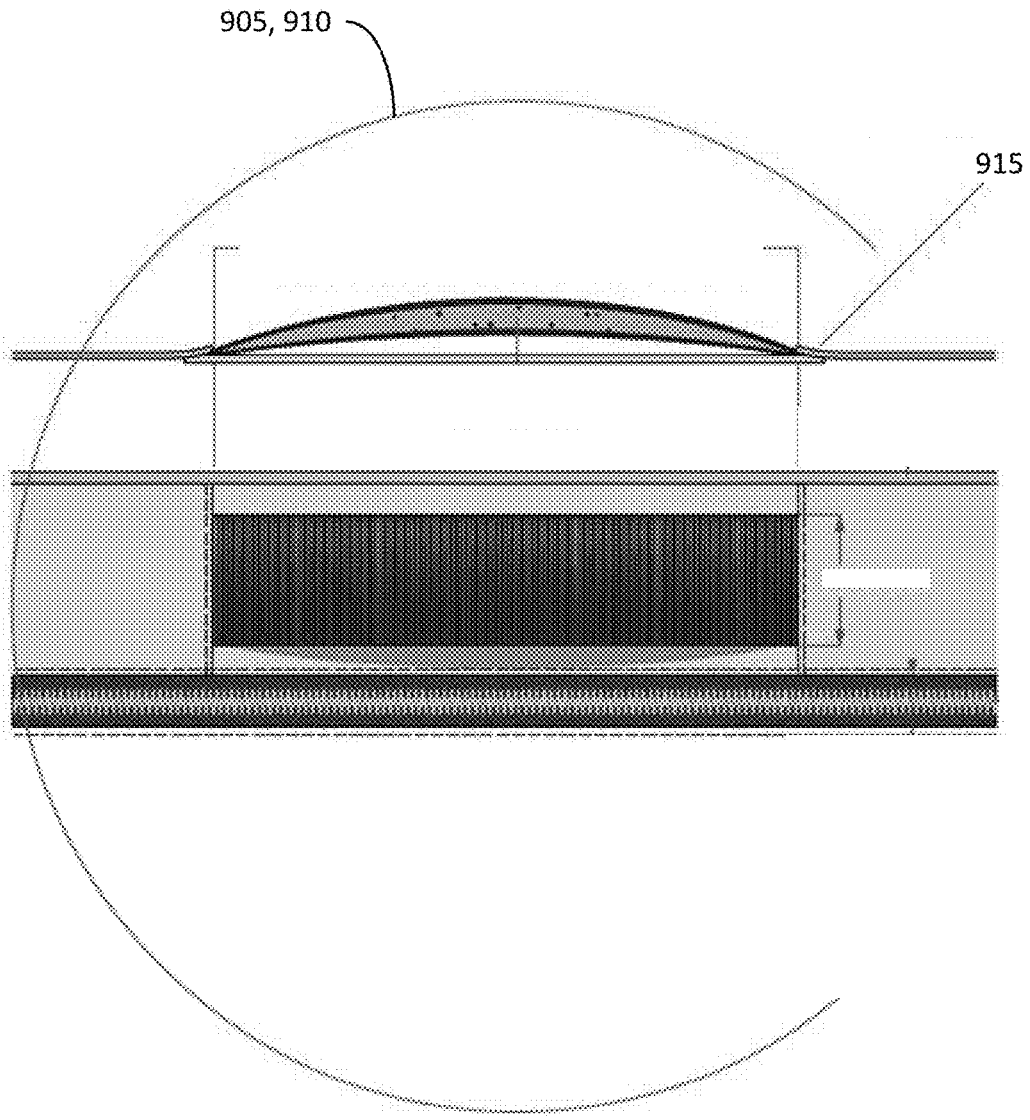
FIG. 10 illustrates a close-up view of a grab handle of FIGS. 9A and 9B.

FIG. 10 illustrates a close-up cross sectional view of the grab handles of FIGS. 9A and 9B. As can be seen, the grab handles can be captured and secured at seams 915. In addition, the grab handles 905 and 910 can be made of tubular webbing that is stuffed with cross-link foam or other suitable stuffing material. In this manner, the grab handles 905 and 910 provide comfortable and efficient lifting access to the luggage bag 100.

Figure 11:
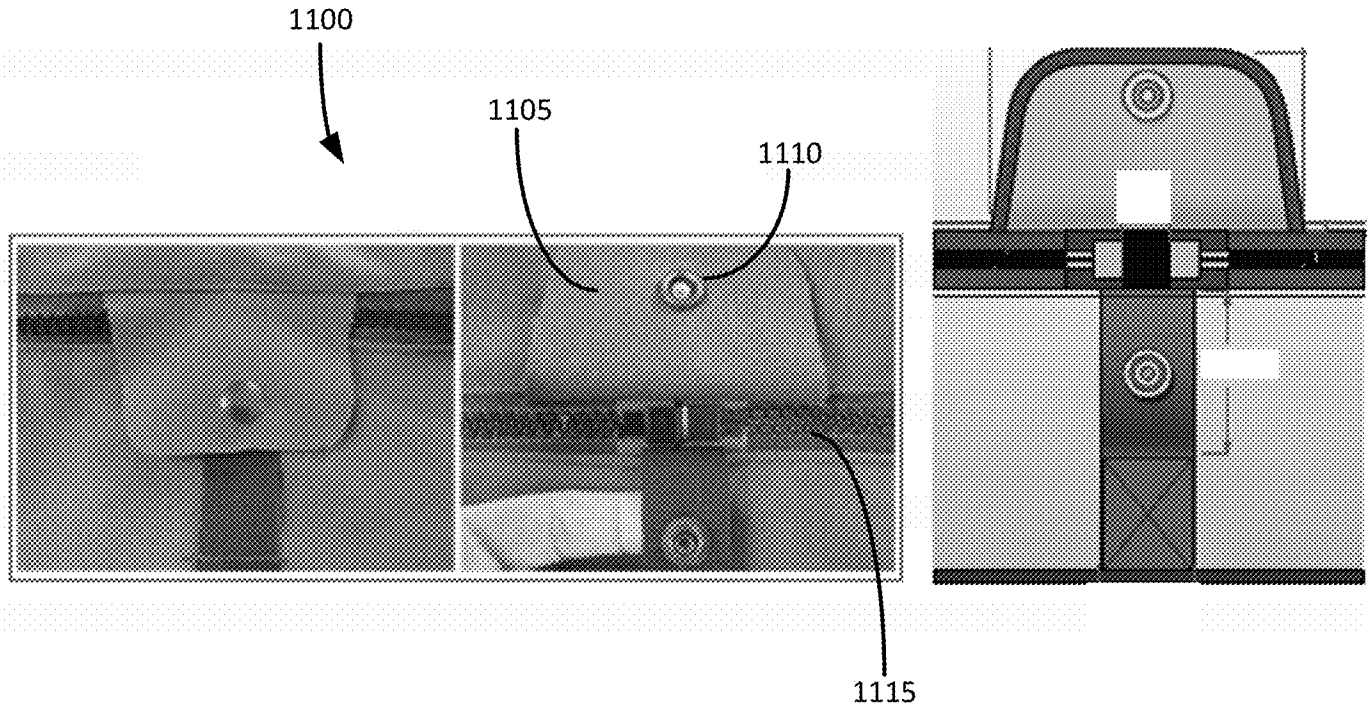
FIG. 11 illustrates a close-up of an example of a detachable zipper and flap construction.

FIG. 11 illustrates a close-up of an example of a detachable zipper and flap mechanism 1100. The detachable zipper and flap mechanism 1100 can include a connective cover flap 1105, which may include a securing means such as a snap 1110. The connective cover flap 1105 may fold down over an adjoining zipper section 1115 and snap into place using the securing means 1110. The connective cover flap 1105 may therefore cover and secure one or more locations on the luggage bag 100 where zippers or other connectors meet.

Thus, the luggage bag 100 is very portable and can securely store items within the organizer 110 in an orderly manner. The organizer 110 can also be configured in a wide variety of ways according to the desires of the user. In a single motion, the luggage bag 100 can be transformed from limited access to the contents to complete access almost instantaneously while maintaining organization of the contents. Similarly, in another single motion, the compartments of the organizer 110 can be quickly and conveniently folded back into the outer container 105 of the luggage bag 100.

Figure 12:
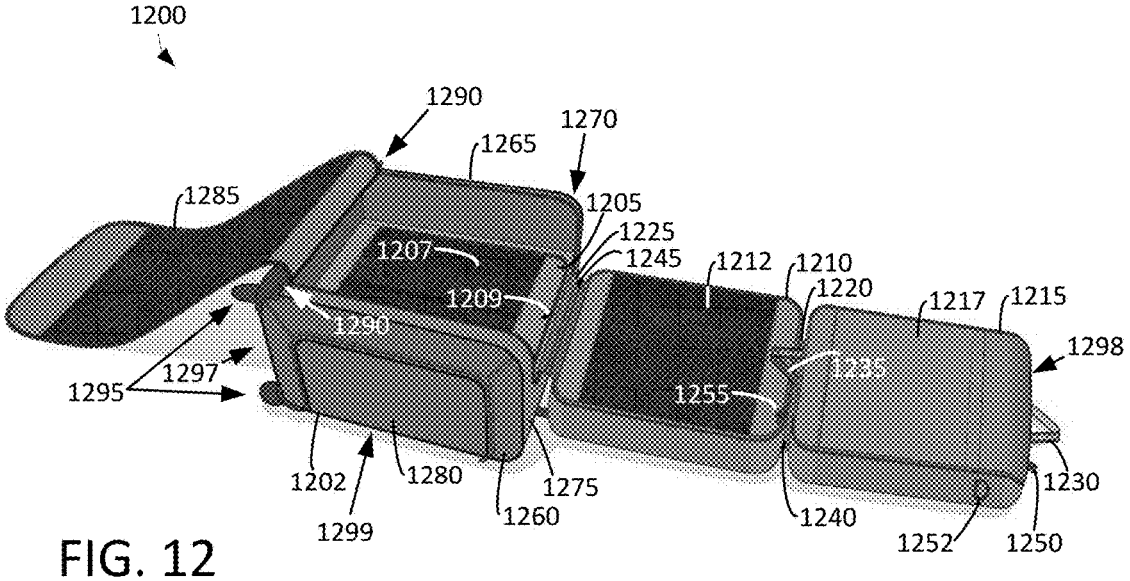
FIG. 12 illustrates a perspective view of an overhead luggage bag including an outer container in an opened configuration, a built-in compartment within the outer container, and first and second removable compartments in accordance with various inventive concepts of the present invention.

FIG. 12 illustrates a perspective view of an overhead luggage bag 1200 including an outer container 1202 in an opened configuration, a built-in compartment 1205 within the outer container 1202, a first removable compartment 1210, and a second removable compartment 1215 in accordance with various inventive concepts of the present invention. The outer container 1200 can be constructed, for example, of rugged cloth material, lining materials such as polyester, lightweight metals such as aluminum, hard or rigid plastics, composite materials, or any other suitable kind of material. In some embodiments, the entire outer container 1202 can be constructed of a metal such as molded aluminum. Other materials can be used to construct the entire outer container such as a metal amalgam, a composite material, a cloth material, or the like.

The outer container 1202 can include an organizer having the built-in compartment 1205, the first removable compartment 1210, and the second removable compartment 1215. The organizer can include a first connector 1220, which can connect and disconnect the first removable compartment 1210 to and from the second removable compartment 1215 using, for example, one or more zippers 1240. The organizer can include a second connector 1225, which can connect and disconnect the first removable compartment 1210 to and from the built-in compartment 1205 using, for example, one or more zippers 1245.

For example, the first connector 1220 and/or the second 1225 can include stitching or other material type that permanently fixes the compartments together. In other embodiments, the connectors 1220 and/or 1225 can include one or more zippers (e.g., 1240 and 1245), pile tape (e.g., VELCRO™), snaps, buttons, or other suitable connector for removably connecting the compartments. The compartments 1210 and 1215 can be aligned (when unfolded) such that adjacent sidewalls are connected together.

The organizer can include a first pull handle or strap 1230 connected to the second removable compartment 1215, and a second pull handle or strap 1235 connected to the second removable compartment 1215. The first pull handle or strap 1230 can unfold and deploy the first and second removable compartments 1210 and 1215 from the outer container 1202. The second pull handle or strap 1235 can fold the first and second removable compartments 1210 and 1215 one atop the other into the outer container 1202 atop the built-in compartment 1205.

The outer container 1202 can include a first rigid sidewall 1260 disposed at a first end of the outer container 1202, and a second rigid sidewall 1265 disposed at a second end opposite the first end of the outer container 1202. The first rigid sidewall 1260 and/or second rigid sidewall 1265 can include one or more curved corners (e.g., 1270) that maintain their shape whether in an open configuration or a closed configuration. The outer container 1202 can include an outer flap 1285 configured to be attached to the first rigid sidewall 1260 and/or to the second rigid sidewall 1265 along the one or more curved corners (e.g., 1270), such that the outer flap 1285 can cover the first and second removable compartments 1210 and 1215 within the outer container 1202.

The outer container 1202 can include a third rigid wall 1297 disposed at a third end perpendicular to the first and second rigid sidewalls 1260 and 1265. A plurality of casters or wheels 1295 can be disposed on the third rigid wall 1297 of the outer container 1202. The outer flap 1285 can be attached to the first rigid sidewall 1260 and/or to the second rigid sidewall 1265, such that the outer flap 1285 can cover the first and second removable compartments 1210 and 1215 within the outer container 1202. The outer container 1202 can include a fourth rigid wall 1275 opposite the third rigid wall 1297. The outer container 1202 can include a rigid support wall 1299 that is perpendicular to the first rigid sidewall 1260, the second rigid sidewall 1265, the third rigid wall 1297, and the fourth rigid wall 1275. The outer flap 1295 can be at least partially removably attached to one or more of the first rigid sidewall 1260, the second rigid sidewall 1265, and/or the fourth rigid wall 1275 of the outer container 1202, for instance, via one or more zippers 1290, snaps, or other closure.

The built-in compartment 1205 can include a support wall corresponding with the rigid support wall 1299 of the outer container 1202, an inner access flap 1207, and first, second, third, and fourth sidewalls. In other words, the rigid support wall 1299 and lower portions of the first and second rigid sidewalls 1260 and 1265 of the outer container 1202, and lower portions of the rigid third and fourth walls 1297 and 1275, can correspond to a support wall and sidewalls of the built-in compartment 1205. Put differently, the rigid support wall 1299 can also act as the support wall for the built-in compartment 1205, a lower portion of the first rigid sidewall 1260 of the outer container 1202 can act as a sidewall of the built-in compartment 1205, a lower portion of the second rigid sidewall 1265 of the outer container 1202 can act as another sidewall of the built-in compartment 1205, a lower portion of the third rigid sidewall 1297 of the outer container 1202 can act as yet another sidewall of the built-in compartment 1205, and a lower portion of the fourth rigid sidewall 1275 of the outer container can act as still another sidewall of the built-in compartment 1205.

The inner access flap 1207 of the built-in compartment can be at least partially light-transmissive. For example, the inner access flap 1207 can be made of a see-through mesh material and/or stretch-mesh material. The support wall and the first, second, third, and fourth sidewalls of the built-in compartment 1205 can be substantially opaque. The inner access flap 1207 can also be at least partially removably attached to one or more of the sidewalls of the built-in compartment 1205, for instance, via one or more zippers 1209, snaps, or other closure. Accordingly, the inner access flap 1207 can be detached (e.g., unzipped) from one or more of the sidewalls of the built-in compartment 1205 to provide access into the built-in compartment 1205, and items can be placed within the built-in compartment 1205. Then, the inner access flap 1207 can be selectively attached (e.g., zipped) to the sidewalls to secure the items within the built-in compartment 1205.

The first removable compartment 1210 can include a support wall, an inner access flap 1212, and first, second, third, and fourth sidewalls, that are separate and spaced apart from the built-in compartment 1205 and the second removable compartment 1215. The support wall and the first, second, third, and fourth sidewalls of the first removable compartment 1210 can be substantially opaque and/or made of compression molded material. The support wall of the first removable compartment 1210 can lay flat atop a surface when in an unfolded configuration.

The inner access flap 1212 of the first removable compartment 1210 can be at least partially light-transmissive. For example, the inner access flap 1212 can be made of a see-through mesh material and/or stretch-mesh material. The inner access flap 1212 can also be at least partially removably attached to one or more of the sidewalls of the first removable compartment 1212, for instance, via one or more zippers 1255, snaps, or other closure. Accordingly, the inner access flap 1212 can be detached (e.g., unzipped) from one or more of the sidewalls of the first removable compartment 1210 to provide access into the first removable compartment 1210, and items can be placed within the first removable compartment 1210. Then, the inner access flap 1212 can be selectively attached (e.g., zipped) to the sidewalls to secure the items within the first removable compartment 1210.

The second removable compartment 1215 can include a support wall, an inner access flap 1217, and first, second, and third sidewalls that are separate and spaced apart from the built-in compartment 1205 and the first removable compartment 1210. The support wall and the first, second, third, and fourth sidewalls of the second removable compartment 1215 can be substantially opaque and/or made of compression molded material. The support wall of the second removable compartment 1215 can lay flat atop a surface when in an unfolded configuration.

The inner access flap 1217 of the second removable compartment 1215 can be substantially opaque. The inner access flap 1217 can be at least partially removably attached to one or more of the sidewalls of the second removable compartment 1215, for instance, via one or more zippers 1250, snaps, or other closure. Accordingly, the inner access flap 1217 can be detached (e.g., unzipped) from one or more of the sidewalls of the second removable compartment 1215 to provide access into the second removable compartment 1215, and items can be placed within the second removable compartment 1215. Then, the inner access flap 1217 can be selectively attached (e.g., zipped) to the sidewalls to secure the items within the second removable compartment 1215. Moreover, the inner access flap 1217 can curve around an end of the second removable compartment 1215 such that the inner access flap 1217 acts as a portion of a sidewall of the second removable compartment 1215 as shown at 1298, and as further described below.

The second pull handle or strap 1235 can be lifted such that the second removable compartment 1215 can be folded on the first removable compartment 1210, and the first removable compartment 1210 can be folded on the built-in compartment 1205, in a folded configuration. In the folded configuration, the built-in compartment 1205 and the second removable compartment 1210 can be in an upright orientation, and the first removable compartment 1215 can be in an inverted orientation, relative to each other. The organizer including the various compartments can fit in a folded configuration between the first rigid wall 1260 and the second rigid wall 1265 within the outer container 1202.

The overhead luggage bag 1200 can include an external-access storage area 1280 disposed on an outer surface of at least one of the first rigid wall 1260 or the second rigid wall 1265. The second removable compartment 1215 can include a D-ring 1252 to assist in unfolding the compartments and/or carrying the second removable compartment 1215.

Figure 13:
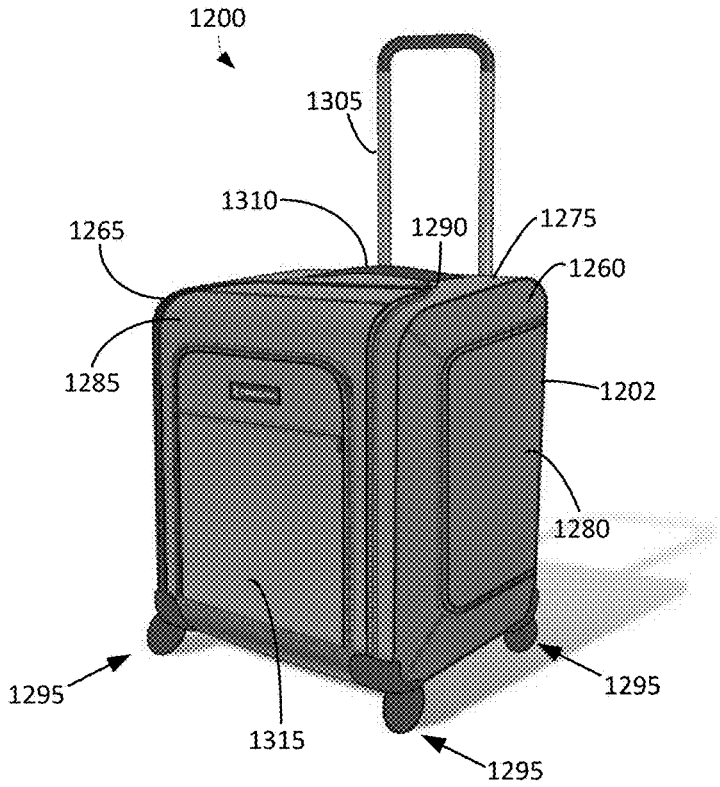
FIG. 13 illustrates a perspective view of the overhead luggage bag of FIG. 12 in a closed configuration.

FIG. 13 illustrates a perspective view of the overhead luggage bag 1200 of FIG. 12 in a closed configuration. Some elements shown in FIG. 13 are described in detail above, and therefore a detailed description of such elements is not necessarily repeated. The overhead luggage bag 1200 can include an external-access storage area 1315 disposed on an outer side of the outer flap 1285, which can store a notebook, papers, a laptop computer, airline ticket information, or the like.

The overhead luggage bag 1200 can include a telescoping handle 1305. It will be appreciated, that the container 1202 can vary in many ways from the container 1202 shown in the Figures. Indeed, the container 1202 can be of any suitable type, can have any suitable shape, and can incorporate one or more additional features typically found on other bags, luggage, briefcases, handbags, purses, and the like. The overhead luggage bag 1200 can include one or more grab handles 1310 disposed atop the rigid wall 1275 adjacent the telescoping handle 1305.

Figure 14:
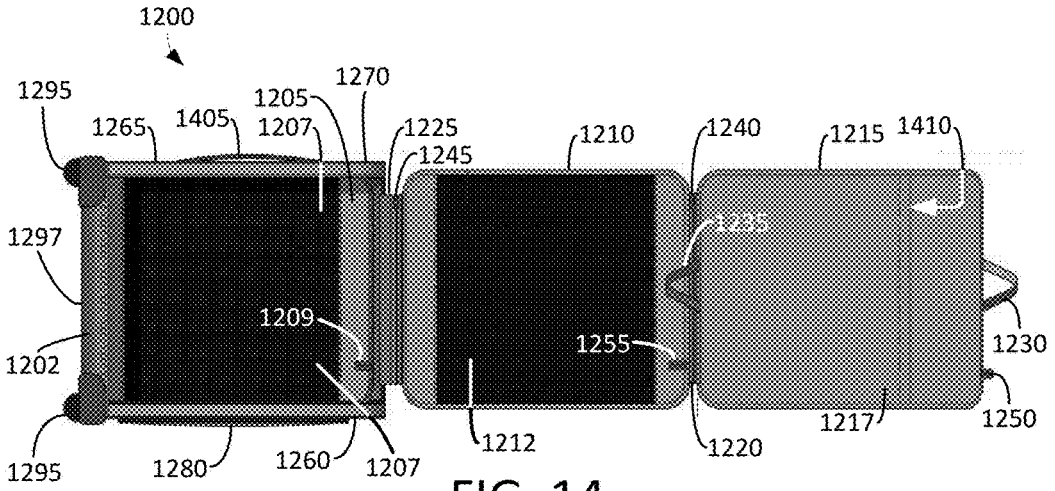
FIG. 14 illustrates a plan view of the overhead luggage bag of FIG. 12 in an opened configuration.

FIG. 14 illustrates a plan view of the overhead luggage bag 1200 of FIG. 12 in an opened configuration. Some elements shown in FIG. 14 are described in detail above, and therefore a detailed description of such elements is not necessarily repeated. The overhead luggage bag 1200 can include a second grab handle 1405 disposed on the rigid sidewall 1265 opposite the rigid sidewall 1260 having the external-access storage area 1280. In this manner, the two grab handles 1310 (of FIG. 13) and 1405 (of FIG. 14) provide two-handed grabbing and lifting from an overhead compartment in an airplane, from a trunk of a vehicle, from a baggage carousel, or the like. The overhead luggage bag 1200 can include a slip pocket 1410 in which relatively flat items such as papers, notebooks, or the like, can be conveniently stored.

Figure 15:
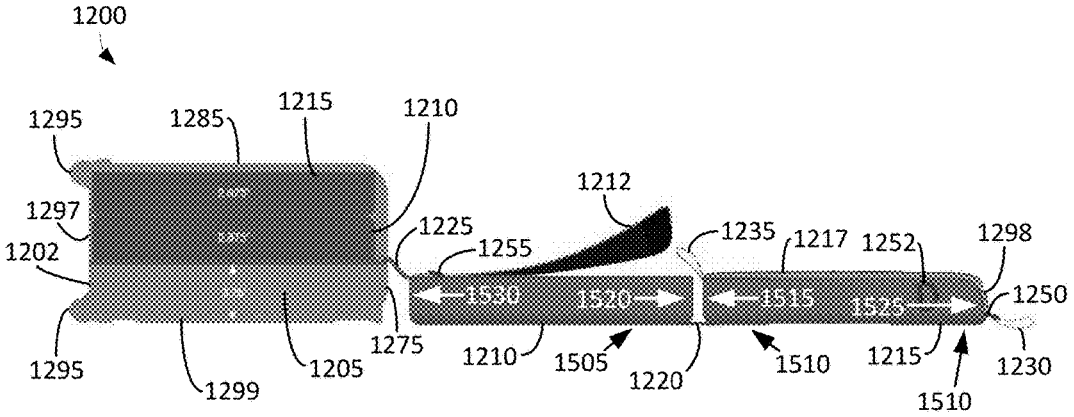
FIG. 15 illustrates a side elevation view of the overhead luggage bag of FIG. 12 showing the relative positions of the built-in and removable compartments in both closed and open configurations.

FIG. 15 illustrates a side elevation view of the overhead luggage bag 1200 of FIG. 12 showing the relative positions of the built-in and removable compartments in both closed and open configurations. Some elements shown in FIG. 15 are described in detail above, and therefore a detailed description of such elements is not necessarily repeated.

The first connector 1220 can be located along one region of a support wall 1505 of the first removable compartment 1210. The first connector 1220 can connect the second removable compartment 1215 to the first removable compartment 1210 such that the first connector 1220 connects the support wall 1505 of the first removable compartment 1210 and a support wall 1510 of the second removable compartment 1215. The second connector 1225 can be located along another region of the inner access flap 1212 of the first removable compartment 1210. The second connector 1225 can connect the first removable compartment 1210 to the built-in compartment 1205.

The first connector 1220 can be located along one edge or region of the support wall 1505, the sidewall 1520, the support wall 1510, and/or the sidewall 1515. The second connector 1225 can be located along one edge or region of a sidewall 1530 of the first removable compartment 1210 and/or a sidewall of the built-in compartment 1205.

The first pull handle or strap 1230 can be connected at an end of the second removable compartment 1215 in a first region including a support wall 1510 of the second removable compartment 1215. The second pull handle or strap 1235 can be connected in a second region including a sidewall 1515 of the second removable compartment 1215 opposite a sidewall 1520 of the first removable compartment 1210. In some embodiments, the second pull handle or strap 1235 can be disposed between the first removable compartment 1210 and the second removable compartment 1215. For example, the second pull handle or strap 1235 can be disposed directly opposite the first connector 1220 relative to the sidewall 1515 of the second removable compartment 1215.

The inner access flap 1217 can curve around an end of the second removable compartment 1215, as shown at 1298, such that the inner access flap 1217 can act as a portion of a sidewall 1525 of the second removable compartment 1215. The one or more zippers 1250 can follow the curvature of the rounded sidewalls of the second removable compartment 1215. Disconnecting the inner access flap 1217 from the sidewall 1525 by unzipping the inner access flap 1217 in the region 1298 of the second removable compartment 1215 creates an easy-access portal into the second removable compartment 1215, as further described in detail below.

The second pull handle or strap 1235 can be lifted such that the second removable compartment 1215 can be folded on the first removable compartment 1210, and the first removable compartment 1210 can be folded on the built-in compartment 1205, in a folded configuration, as shown in FIG. 15. Also shown in FIG. 15 is the first and second removable compartments 1210 and 1215 in the unfolded configuration. Although dimensions in inches are shown in FIG. 15 of the various compartments, it will be understood that the compartments can have any suitable dimensions without departing from the inventive concepts disclosed herein.

The overhead luggage bag 1200 is very portable and can securely store items within the organizer in an orderly manner. The built-in compartment 1205 provides an internal access compartment while the removable compartments 1210 and 1215 can be easily deployed and/or separated from each other and from the built-in compartment 1205. The compartments 1205, 1210, and 1215 can also be configured in a wide variety of ways according to the desires of the user. In a single motion, the luggage bag 1200 can be transformed from limited access to the contents to complete access almost instantaneously while maintaining organization of the contents. Similarly, in another single motion, the compartments can be quickly and conveniently folded back into the outer container 1202 of the overhead luggage bag 1200.

The organizer can be modular such that the compartments 1210 and 1215 can be configured in any desirable manner. For example, one or more compartments (e.g., 1210 or 1215) can be attached and added to the overhead luggage bag 1200, or one or more compartments (e.g., 1210 or 1215) can be detached and removed from the overhead luggage bag 1200. This modularity allows the overhead luggage bag 1200 to be configured as desired. The various compartments are foldable one atop the other. The organizer can, thus, take up substantially the entire interior volume of the outer container 1202 or less than the entire interior volume.

Figure 16:
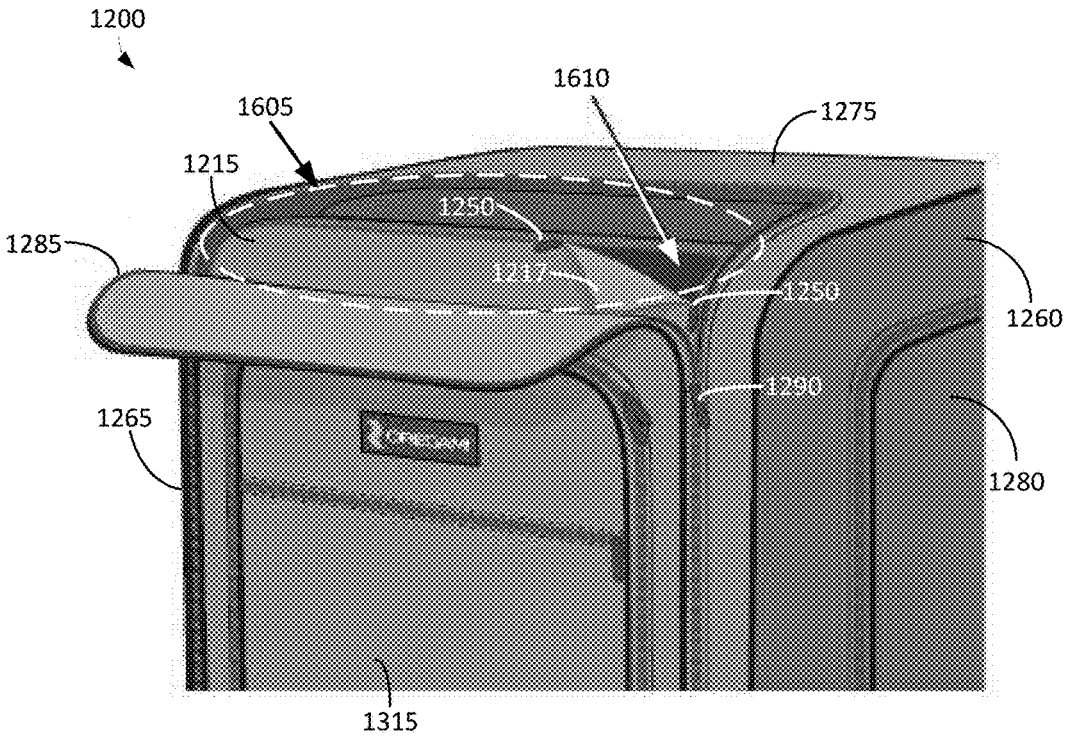
FIG. 16 illustrates a close-up view of a portion of the overhead luggage bag of FIG. 12 including an easy-access portal through which contents of the luggage bag can be conveniently accessed without fully opening the luggage bag.

FIG. 16 illustrates a close-up view of a portion of the overhead luggage bag 1200 of FIG. 12 including one or more easy-access portals (e.g., 1605 and 1610) through which contents of the luggage bag can be conveniently accessed without fully opening the luggage bag. Some elements shown in FIG. 16 are described in detail above, and therefore a detailed description of such elements is not necessarily repeated.

When in a closed configuration, contents of at least one of the removable compartments (e.g., 1215) can be accessed through an external easy-access portal 1605 without requiring the full opening and deployment of the internal compartments. The external easy-access portal 1605 can be associated with or otherwise pass through an opening in the fourth rigid wall 1275, through which contents of the second removable compartment 1215 can be accessed while the outer flap 1285 is substantially detached from the fourth rigid wall 1275 and substantially attached to the first and second rigid walls 1260 and 1265. In addition, the second removable compartment 1215 can include an internal easy-access portal 1610 through which the contents of the second removable compartment 1215 can be accessed. In other words, when the overhead luggage bag 1200 is in an upright position in which the casters or wheels 1295 are in contact with or otherwise substantially facing toward a floor, the outer flap 1285 can be partially unzipped using the one or more zippers 1290 or otherwise disconnected from the fourth rigid wall 1275 and/or partially unzipped using the one or more zippers 1290 or otherwise partially disconnected from the first and second rigid sidewalls 1260 and 1265, to provide access through the top of the luggage bag 1200 to the internal compartments. Then, the inner access flap 1217 can be partially unzipped using the one or more zippers 1250 or otherwise partially disconnected from one or more sidewalls of the second removable compartment 1215 for simple and convenient access to the items or contents stored within the second removable compartment 1215. Put differently, contents of the second removable compartment 1215 can be conveniently accessed through the internal easy-access portal 1610 and/or the external easy-access portal 1605, without unfolding or deploying the compartments from the outer container 1202.

Figure 17:
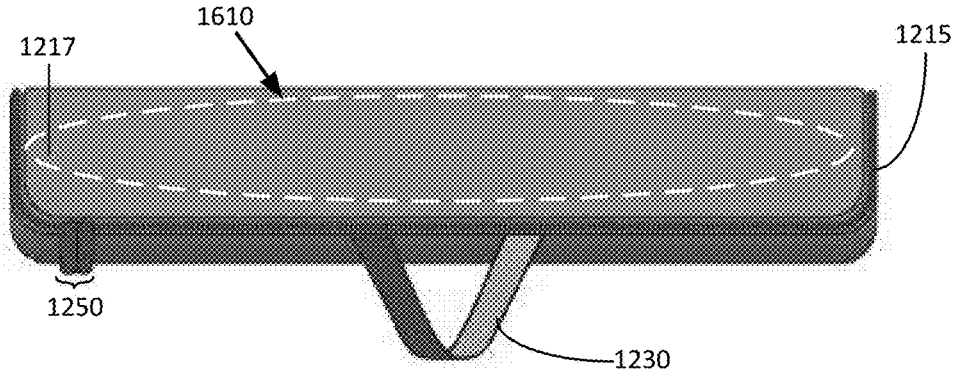
FIG. 17 illustrates an inner access flap and easy-access portal of a removable compartment of the overhead luggage bag of FIG. 12 in accordance with inventive concepts.

FIG. 17 illustrates an inner access flap 1217 and internal easy-access portal 1610 of a removable compartment 1215 of the overhead luggage bag 1200 of FIG. 12 in accordance with inventive concepts. Some elements shown in FIG. 17 are described in detail above, and therefore a detailed description of such elements is not necessarily repeated. The one or more zippers 1250 or other suitable fasteners can be used to partially detach the inner access flap 1217 from one or more sidewalls of the second removable compartment 1215, thereby opening up the internal easy access portal 1610.

Having described and illustrated the principles of the invention with reference to illustrated embodiments, it will be recognized that the illustrated embodiments can be modified in arrangement and detail without departing from such principles, and can be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms can reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. A luggage bag, comprising:

an outer container including a support wall, a first sidewall, a second sidewall, a third sidewall, and a fourth sidewall;

an organizer including a built-in compartment, a first removable compartment, and a second removable compartment;

a first connector configured to connect the second removable compartment to the first removable compartment;

a second connector configured to connect the first removable compartment to the built-in compartment;

a first pull handle or strap connected to the second removable compartment; and a second pull handle or strap connected to the second removable compartment, wherein:

the support wall of the outer container is a support wall of the built-in compartment;

a lower portion of the first sidewall of the outer container is a first sidewall of the built-in compartment;

a lower portion of the second sidewall of the outer container is a second sidewall of the built-in compartment;

a lower portion of the third sidewall of the outer container is a third sidewall of the built-in compartment;

a lower portion of the fourth sidewall of the outer container is a fourth sidewall of the built-in compartment;

the built-in container is non-removable from the outer container;

the built-in compartment includes an inner access flap;

the support wall and the first, second, third, and fourth sidewalls of the built-in compartment are substantially opaque;

the inner access flap of the built-in compartment is at least partially light-transmissive;

the first removable compartment includes a support wall, an inner access flap, and first, second, third, and fourth sidewalls, that are separate and spaced apart from the built-in compartment and the second removable compartment;

the support wall and the first, second, third, and fourth sidewalls of the first removable compartment are substantially opaque;

the inner access flap of the first removable compartment is at least partially light-transmissive;

the second removable compartment includes a support wall, an inner access flap, and first, second, and third sidewalls that are separate and spaced apart from the built-in compartment and the first removable compartment; and the support wall, the inner access flap, and the first, second, third, and fourth sidewalls of the second removable compartment are substantially opaque.

2. The luggage bag of claim 1, wherein:

the first connector is located along one region of the support wall of the first removable compartment;

the first connector connects the second removable compartment to the first removable compartment such that the first connector connects the support wall of the first removable compartment and the support wall of the second removable compartment;

the second connector is located along another region of the inner access flap of the first removable compartment; and the second connector connects the first removable compartment to the built-in compartment.

3. The luggage bag of claim 2, wherein:

the first pull handle or strap is configured to unfold and deploy the first and second removable compartments from the outer container; and the second pull handle or strap is configured to fold the first and second removable compartments one atop the other into the outer container atop the built-in compartment.

4. The luggage bag of claim 1, wherein:

the light-transmissive wall of the built-in compartment is at least partially removably attached to one or more other walls of the built-in compartment;

the light-transmissive wall of the first removable compartment is at least partially removably attached to one or more other walls of the first removable compartment; and the inner access flap of the second removable compartment is at least partially removably attached to one or more other walls of the second removable compartment.

5. The luggage bag of claim 4, wherein:

the support wall and the first, second, third, and fourth sidewalls of the first removable compartment are made of compression molded material; and the support wall and the first, second, and third sidewalls of the second removable compartment are made of compression molded material.

6. The luggage bag of claim 1, wherein:

the first pull handle or strap is connected at an end of the second removable compartment in a first region including the support wall of the second removable compartment, and the second pull handle or strap is connected in a second region including a sidewall from among the first, second, third, and fourth sidewalls of the second removable compartment opposite a sidewall from among the first, second, third, and fourth sidewalls of the first removable compartment.

7. The luggage bag of claim 6, wherein:

the second pull handle or strap is disposed between the first removable compartment and the second removable compartment, and the second pull handle or strap is disposed directly opposite the first connector relative to the sidewall of the second removable compartment.

8. The luggage bag of claim 7, wherein:

the second pull handle or strap is configured to be lifted such that the second removable compartment is configured to be folded on the first removable compartment, and the first removable compartment is configured to be folded on the built-in compartment, in a folded configuration, and in the folded configuration, the built-in compartment and the second removable compartment are in an upright orientation, and the first removable compartment is in an inverted orientation, relative to each other.

9. The luggage bag of claim 1, wherein:

the first sidewall of the outer container is a first rigid wall disposed at a first end of the outer container, wherein the first rigid wall includes one or more curved corners that maintain their shape whether in an open configuration or a closed configuration;

the second sidewall of the outer container is a second rigid wall disposed at a second end opposite the first end of the outer container, wherein the second rigid wall includes one or more curved corners that maintain their shape whether in the open configuration or the closed configuration; and wherein the outer container further comprises:

an outer flap configured to be attached to the first rigid wall along the one or more curved corners, and to the second rigid wall along the one or more curved corners, such that the outer flap is configured to cover the first and second removable compartments within the outer container.

10. The luggage bag of claim 9, wherein:

the organizer is configured to fit in a folded configuration between the first rigid wall and the second rigid wall within the outer container.

11. The luggage bag of claim 9, further comprising:

an external-access storage area disposed on an outer surface of at least one of the first rigid wall or the second rigid wall.

12. The luggage bag of claim 1, wherein:

the first sidewall of the outer container is a first rigid wall disposed at a first end of the outer container;

the second sidewall of the outer container is a second rigid wall disposed at a second end opposite the first end of the outer container;

the third sidewall of the outer container is a third rigid wall disposed at a third end perpendicular to the first and second rigid walls;

wherein the luggage bag further comprises:

a plurality of casters disposed on the third rigid wall of the outer container; and an outer flap configured to be attached to the first rigid wall and to the second rigid wall, such that the outer flap is configured to cover the first and second removable compartments within the outer container.

13. A luggage bag, comprising:

an outer container;

an organizer including a built-in compartment, a first removable compartment, and a second removable compartment;

a first connector configured to connect the second removable compartment to the first removable compartment;

a second connector configured to connect the first removable compartment to the built-in compartment;

a first pull handle or strap connected to the second removable compartment;

a second pull handle or strap connected to the second removable compartment;

a first rigid wall disposed at a first end of the outer container;

a second rigid wall disposed at a second end opposite the first end of the outer container;

a third rigid wall disposed at a third end perpendicular to the first and second rigid walls;

a plurality of casters disposed on the third rigid wall of the outer container;

an outer flap configured to be attached to the first rigid wall and to the second rigid wall, such that the outer flap is configured to cover the first and second removable compartments within the outer container;

a fourth rigid wall opposite the third rigid wall; and an external easy-access portal associated with the fourth rigid wall through which contents of the second removable compartment can be accessed while the outer flap is substantially detached from the fourth rigid wall and substantially attached to the first and second rigid walls.

14. The luggage bag of claim 13, wherein:

the second removable compartment includes an internal easy-access portal through which the contents of the second removable compartment can be accessed.

15. A luggage bag, comprising:

an outer container;

an organizer including a built-in compartment and one or more removable compartments;

a first rigid wall disposed at a first end of the outer container;

a second rigid wall disposed at a second end opposite the first end of the outer container;

a third rigid wall disposed at a third end perpendicular to the first and second rigid walls;

a plurality of casters disposed on the third rigid wall of the outer container;

an outer flap configured to be attached to the first rigid wall and to the second rigid wall, such that the outer flap is configured to cover the one or more removable compartments within the outer container;

a fourth rigid wall opposite the third rigid wall, wherein the outer flap is configured to be attached to the fourth rigid wall; and an external easy-access portal associated with the fourth rigid wall through which contents of the one or more removable compartments can be accessed while the outer flap is substantially detached from the fourth rigid wall and substantially attached to the first and second rigid walls.

16. The luggage bag of claim 15, wherein:

the one or more removable compartments include an internal easy-access portal through which contents of the one or more removable compartments can be accessed.

* * * * *